US009271577B2

(12) United States Patent
Xu

(10) Patent No.: US 9,271,577 B2
(45) Date of Patent: Mar. 1, 2016

(54) EJECTOR MECHANISM FOR ELECTRIC BED

(71) Applicant: Jianchun Xu, Jiaxing (CN)

(72) Inventor: Jianchun Xu, Jiaxing (CN)

( * ) Notice: Subject to any disclaimer, the term of this patent is extended or adjusted under 35 U.S.C. 154(b) by 0 days.

(21) Appl. No.: 14/300,957

(22) Filed: Jun. 10, 2014

(65) Prior Publication Data

US 2015/0067964 A1 Mar. 12, 2015

(30) Foreign Application Priority Data

Sep. 10, 2013 (CN) ..... 2013 2 0559271 U

(51) Int. Cl.
*A47C 20/00* (2006.01)
*A61G 7/012* (2006.01)

(52) U.S. Cl.
CPC ..... *A47C 20/00* (2013.01); *A61G 7/012* (2013.01)

(58) Field of Classification Search
CPC ..... A47C 20/041; A47C 20/00; A61G 7/015; A61G 7/012; A61G 7/018
See application file for complete search history.

(56) References Cited

U.S. PATENT DOCUMENTS 3,191,196 A * 6/1965 Holm ..... 5/616
4,062,074 A * 12/1977 Holland ..... 5/607
5,245,718 A * 9/1993 Krauska ..... 5/618
5,537,701 A * 7/1996 Elliott ..... 5/617
6,393,641 B1 * 5/2002 Hensley ..... 5/618
6,826,793 B2 * 12/2004 Tekulve ..... 5/618
8,484,781 B2 * 7/2013 Kong ..... 5/618
2004/0055087 A1 * 3/2004 Edgerton ..... 5/611
2006/0021143 A1 * 2/2006 Lemire ..... 5/611
2006/0026762 A1 * 2/2006 Hornbach et al. ..... 5/611
2006/0059621 A1 * 3/2006 Poulos et al. ..... 5/430
2006/0277683 A1 * 12/2006 Lamire et al. ..... 5/600
2007/0174965 A1 * 8/2007 Lemire et al. ..... 5/600
2009/0038074 A1 * 2/2009 Barthelt ..... 5/611
2009/0094747 A1 * 4/2009 Bly et al. ..... 5/611
2009/0282616 A1 * 11/2009 Carr ..... 5/611
2010/0017965 A1 * 1/2010 Barthelt ..... 5/611
2010/0064441 A1 * 3/2010 Barthelt ..... 5/616
2010/0325797 A1 * 12/2010 Horne ..... 5/611
2010/0325800 A1 * 12/2010 Huang ..... 5/618
2011/0113556 A1 * 5/2011 Roussy et al. ..... 5/611
2012/0023673 A1 * 2/2012 Hornbach ..... 5/611
2012/0054960 A1 * 3/2012 Receveur ..... 5/400
2012/0066832 A1 * 3/2012 Poulos et al. ..... 5/83.1
2012/0089419 A1 * 4/2012 Huster et al. ..... 705/3
2012/0096645 A1 * 4/2012 Shih ..... 5/614
2012/0240696 A1 * 9/2012 Bastholm et al. ..... 74/89.38
2013/0055502 A1 * 3/2013 Kay et al. ..... 5/618
2013/0212807 A1 * 8/2013 Manson et al. ..... 5/618
2013/0219382 A1 * 8/2013 Parsons et al. ..... 717/173

(Continued)

*Primary Examiner* — David E Sosnowski
*Assistant Examiner* — Eric Kurilla
(74) *Attorney, Agent, or Firm* — Clement Cheng

(57) ABSTRACT

A reciprocating ejector mechanism for an electric bed comprising an aperture formed on a bed board. An ejector mechanism is mounted in the aperture. The ejector mechanism includes an ejected part, which is arranged parallel to the bed board. At least one first connecting rod with one end is connected with the ejected part and another end is hinged with a slider. The slider may slide along the guide bar fixed on the bed board. A second connecting rod with one end can be hinged with the middle part of the first connecting rod and another end hinged with the bed board. The ejector mechanism may have a driving device fixed on the bed board and connected with the linkage to drive the first connecting rod to rotate, so that the ejected part is driven to move parallel to the bed board.

5 Claims, 2 Drawing Sheets

(56) References Cited

U.S. PATENT DOCUMENTS

| | | | | |
|---|---|---|---|---|
| 2013/0227788 | A1* | 9/2013 | Turner et al. | 5/613 |
| 2013/0263378 | A1* | 10/2013 | O'Keefe et al. | 5/713 |
| 2013/0318720 | A1* | 12/2013 | Connell et al. | 5/611 |
| 2014/0116168 | A1* | 5/2014 | Viberg | 74/105 |
| 2014/0123389 | A1* | 5/2014 | Hornbach | 5/611 |
| 2014/0137328 | A1* | 5/2014 | Ohta et al. | 5/611 |
| 2014/0189954 | A1* | 7/2014 | Lee | 5/618 |
| 2014/0352060 | A1* | 12/2014 | Hirose | 5/310 |
| 2014/0352068 | A1* | 12/2014 | Xu | 5/616 |
| 2014/0359937 | A1* | 12/2014 | Chang | 5/11 |

* cited by examiner

EJECTOR MECHANISM FOR ELECTRIC BED

This application claims priority from and is a Paris Convention Treaty of non-provisional application of: People's Republic of China utility model patent application 201320559271.1 entitled Electric Bed, filed Sep. 10, 2013, by inventor Xu, Jianchun; the disclosures of which are incorporated herein by reference.

FIELD OF THE INVENTION

The utility model relates to mechanical structure for the electric bed, specifically an ejector mechanism for the electric bed.

BACKGROUND

The electric bed is a new type of bed, where the shape of its bed surface is changeable according to user needs. In order to improve the comfort of the electric bed and further satisfy the user's comfort requirements, relevant manufacturers researched and developed many additional functions. One of these functions includes an ejector mechanism for head and waist positioning such as neck or lumbar support. Ejector mechanisms may allow neck support, lumbar support.

Chinese patent publication CN 201220387006 discloses an electric bed with head and waist ejector functions where a head ejector mechanism uses a composite structure of a hinge and a push rod. The ejected part has one end hinged with a bed board (frame) and another end driven by a linear motor so that the ejected part is ejected during rotation around the hinge joint. The bed board is a bed board frame from which the ejector mechanism protrudes. Thus, the bed board is referred to as the bed board (frame).

The lumbar or waist ejector mechanism uses a lifting pole driven by the motor and can rotate around a fixed point below the bed board (frame) to raise/drop the mattress for the waist, playing a role of supporting or massage.

Curvilinear movement achieves the above-mentioned ejector mechanism used in the prior art. The ejected part is not parallel to the original bed board (frame), so user experience can be poor in case of pinching. Additionally, the head ejector mechanism does not have massage function. The waist ejector mechanism also scrapes with the mattress due to its movement in a curve, thereby shortening the service life of the mattress.

SUMMARY OF THE INVENTION

In order to solve the above technical problems, the present invention provides a reciprocating ejector mechanism by the following technical solution. An ejector mechanism for the electric bed is characterized in that the ejector mechanism is arranged in a hole with a linkage in the bed board (frame), and comprising of an ejected part, which is arranged parallel to the bed board (frame). At least one first connecting rod with one end is connected with the ejected part and another end is hinged with a slider. The slider may slide along the guide bar fixed on the bed board (frame).

Furthermore, a second connecting rod has one end hinged with the middle part of the first connecting rod and another end hinged with the bed board (frame). The ejector mechanism further includes a driving device, which is fixed on the bed board (frame) and connected with the linkage to drive the first connecting rod to rotate, so that the ejected part is driven to move parallel to the bed board (frame).

The above technical solution may also combine one of more of the following additional technical solutions. The linkage further comprises an auxiliary mechanism with one end hinged with the ejected part and another hinged with the bed board (frame), and the auxiliary mechanism may move synchronously with the driving device. The auxiliary mechanism comprises a third connecting rod and a fourth connecting rod, and they have one end hinged with each other and another end respectively hinged with the ejected part and the bed board (frame). The auxiliary mechanism is of same type as the linkage, and has the third connecting rod has the same configuration with the first connecting rod and the fourth connecting rod having the same configuration with the second connecting rod.

Selectively, the driving device is a rotating motor, which is arranged on the hinge joint between the second connecting rod and the bed board (frame) and used for driving the ejector mechanism by the second connecting rod. Selectively, the driving device is a linear motor, which matches the slider so that the slider moves the guide bar to drive the ejector mechanism. The guide bar is a guide rail fixed on the bed board (frame). The guide bar is a bar member fixed on the bed board (frame). The length of the first connecting rod is two times the length of the second connecting rod. The third connecting rod and the fourth connecting rod have same length. The ejector mechanism may also have a linkage rod, where the two ends of the linkage rod are respectively hinged with the linkage and the auxiliary mechanism so that the linkage links with the auxiliary mechanism. Thus, the stability and strength of the ejector mechanism is improved.

Compared with the prior art, the utility mode uses a straight-line mechanism and a special straight-line mechanism, so that the ejector mechanism moves up and down in vertical direction of the bed board (frame), and can not move in other direction as required. Hence, improving user experience. Additionally, the driving device is the rotating motor, which is arranged on the hinge joint between the second connecting rod and the bed board (frame), to rapidly drive the ejected part to reciprocate up and down so that additional massage function is provided.

The following callout list of elements can be a useful guide in referencing the elements of the drawings.

1 Ejected Part
2 First Connecting Rod
3 Second connecting Rod
4 Linkage Rod
5 Fourth Connecting Rod
6 Third Connecting Rod
7 Guide Bar
8 Slider

DETAILED DESCRIPTION OF THE PREFERRED EMBODIMENTS

The present invention is a pair of four bar mechanisms that are connected to each other. The pair of four bar mechanisms are also connected to a slider actuator that can be motorized for actuating the extension of the present invention. The motorized mechanism can be computer-controlled. The mechanism ejects upward from a retracted flush position to an extended ejected position. The mechanism can reciprocate between the two positions.

Figure 1:
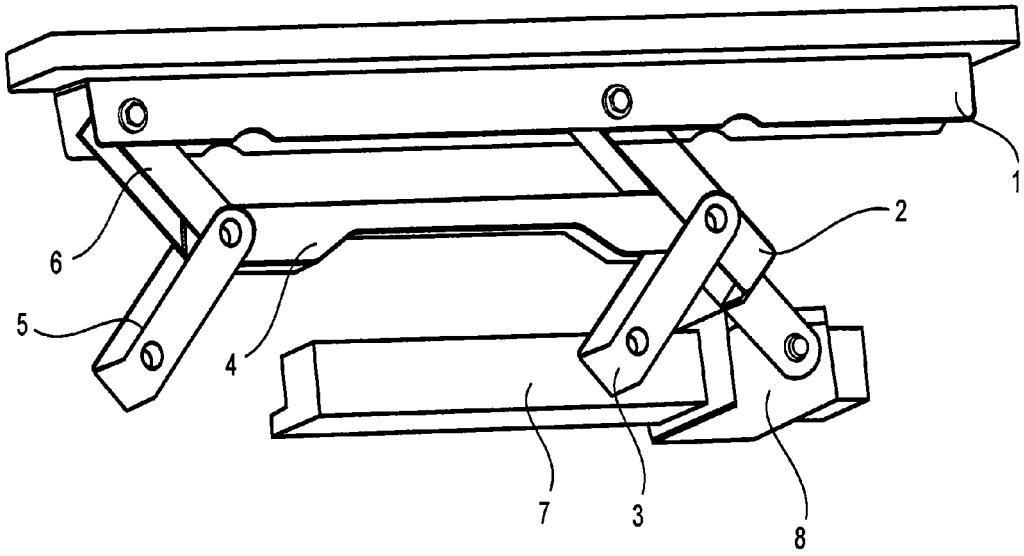
FIG. 1 is a perspective drawing of the ejector mechanism according to the utility model.

FIG. 1 is a perspective drawing of the ejector mechanism according to the utility model. The ejector mechanism comprises the linkage, the auxiliary mechanism and the driving device.

The linkage comprises the ejected part 1 which is arranged approximately parallel to the bed board (frame). At least one first connecting rod 2 with one end connected to the ejected part 1 and another end hinged with the slider 8, wherein the slider 8 is sleeved with the guide bar 7, and the guide bar 7 can be relatively fixed onto the bed board (frame) (not shown in the figure). The second connecting rod 3 with one end hinged with the middle part of the first connecting rod 2, and another end hinged with the bed board (frame).

The auxiliary mechanism is selective, comprising the third connecting rod 6 and a fourth connecting rod 5, and they have one end hinged with each other and another end respectively hinged with the ejected part 1 and the bed board (frame). The auxiliary mechanism may stretch out and draw back correspondingly with the movement of the driving device so that the ejected part 1 moves more smooth.

Selectively the linkage rod 4, which is arranged between the linkage and the auxiliary mechanism, is hinged at the hinge joint between the first connecting rod 2 and the second connecting rod 3, and the hinge joint between the third connecting rod 6 and the fourth connecting rod 5. Thus, the auxiliary mechanism may be driven to move synchronously with the driving device.

Figure 2:
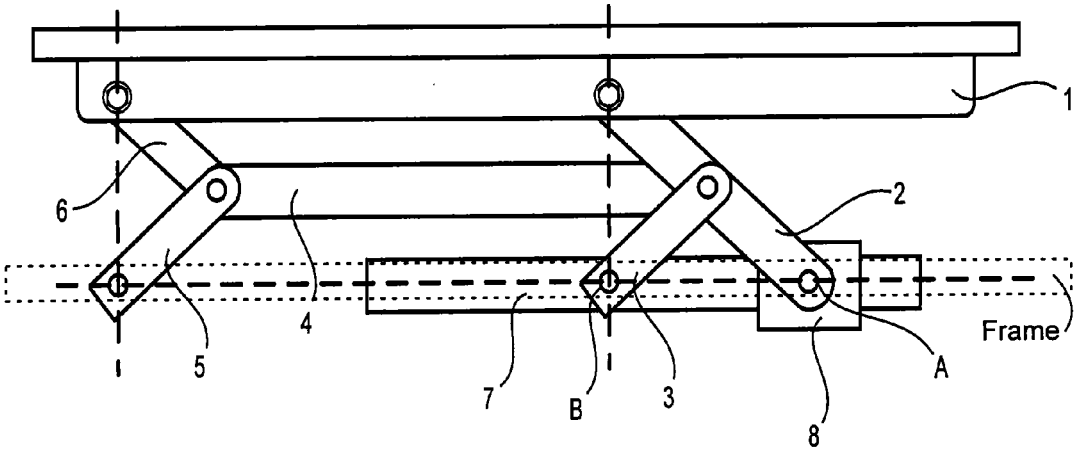
FIG. 2 is a schematic diagram of the ejector mechanism provided in first embodiment according to the utility model, wherein the driving device is the linear motor and installed on the point A.

FIG. 2 shows the first embodiment according to the utility model, wherein the driving device is the linear motor, which is fixed on the bed board (frame), and has a working end connected with the hinge joint between the first connecting rod 2 and the slider 8 (namely the point A). Thus the slider 8 makes rectilinear motion along the guide bar 7 when the linear motor operates, so that the ejected part 1 is driven to raise or fall by the first connecting rod 2 and the second connecting rod 3.

Figure 3:
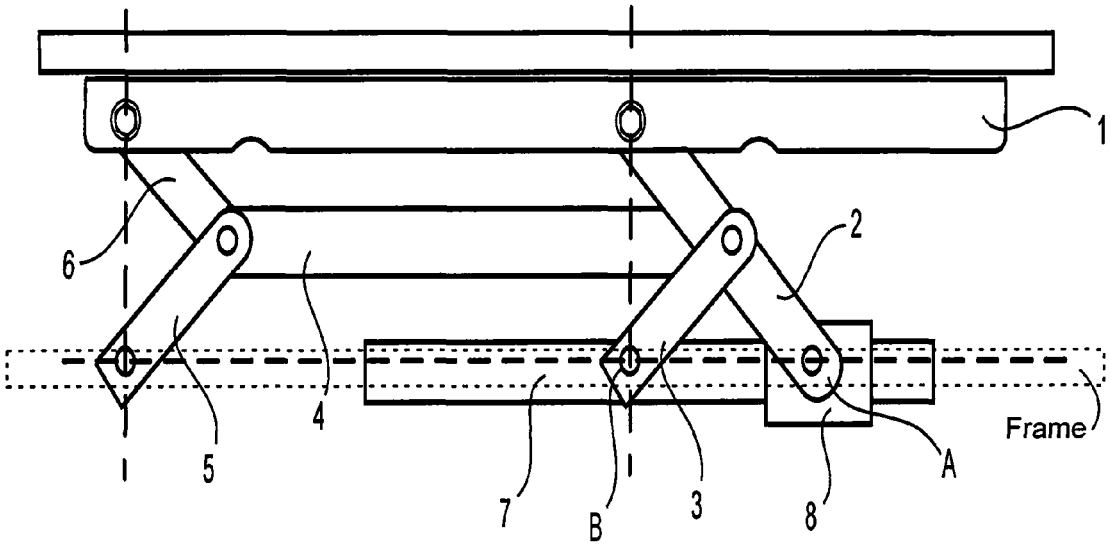
FIG. 3 is a schematic diagram of the ejector mechanism provided in second embodiment according to the utility model, wherein the driving device is the rotating motor and installed on the point B.

FIG. 3 shows the second embodiment according to the utility model, wherein the driving device is the rotating motor, which is arranged on the hinge joint between the second connecting rod 3 and the bed board (frame) (namely the point B). When the rotating motor operates, the motor transfers the rotation into an up and down reciprocating motion perpendicular to the bed board (frame) by the arrangement of the linkage. Thus the ejected part 1 reciprocates up and down within a certain range, so that the massage function is provided when the ejector mechanism is installed on special position (e.g. waist and leg).

In the above embodiment, selectively, the mechanical structure of the auxiliary mechanism may be fully same with the link mechanism. Namely, the third connecting rod 6 and the fourth connecting rod 5, respectively have same configuration with the first connecting rod 2 and the second connecting rod 3, and use same connecting mode.

In the above embodiment, selectively, the guide bar 7 may be a grooved guide rail.

In the above embodiment, selectively, the length of the first connecting rod 2 is two times length of the second connecting rod 3, namely their length meets the length relationship of Scott-Russell straight-line mechanism. Also the second connecting rod 3, the third connecting rod 6 and the fourth connecting rod 5 have same length. By the configuration, the ejected part 1 only moves perpendicular to the bed board (frame) without horizontal movement, so that the sliding between the ejected part 1 and the mattress is reduced; thus, prolonging the service life of the mattress.

Although the utility model is illustrated and described herein, obviously a person skilled in the field may make various modifications, additions, replacements, and etc. within the purport of the utility model, all of which will fall within the right range defined in the following claims.

The invention claimed is:

1. A reciprocating ejector mechanism for an electric bed comprising:

a. an ejector mechanism having an ejected part;

b. a first connecting rod having a first connecting rod upper end pivotally connected to the ejected part and a first connecting rod lower end hinged to a slider, wherein the slider is configured to slide along a guide bar, wherein the guide bar is mounted on a bed board frame;

c. a second connecting rod with a second connecting rod upper end hinged to the first connecting rod and a second connecting rod lower end hinged to the bed board frame; and d. a third connecting rod having a third connecting rod upper end pivotally connected to the ejected part and a third connecting rod lower end hinged to a fourth connecting rod at a fourth connecting rod upper end, wherein the fourth connecting rod has a fourth connecting rod lower end hinged to the bed board frame;

e. a linkage rod connected to the fourth connecting rod upper end and the second connecting rod upper end; and f. a driving device connected to move the slider along the guide bar.

2. The reciprocating ejector mechanism for an electric bed of claim 1, wherein the driving device rotates the first connecting rod so that the ejected part is driven to move parallel to the bed board.

3. The reciprocating ejector mechanism for an electric bed of claim 1, wherein the driving device is a linear motor so that the ejected part is driven to move parallel to the bed board.

4. The reciprocating ejector mechanism for an electric bed of claim 1, wherein the guide bar is a guide rail and a bar shaped member fixed on the bed board, wherein a length of the first connecting rod is two times the length of the second connecting rod.

5. The reciprocating ejector mechanism for an electric bed of claim 1, wherein the third connecting rod and the fourth connecting rod have same length.

* * * * *